US012716316B2

(12) United States Patent
Evers et al.

(10) Patent No.: US 12,716,316 B2
(45) Date of Patent: Aug. 25, 2026

(54) PROTECTIVE LAYER OVER SWELLABLE COMPOUND

(71) Applicant: Halliburton Energy Services, Inc., Houston, TX (US)

(72) Inventors: Rutger Evers, Singapore (SG); Brandon T. Least, Carrollton, TX (US); Prem Jakkula, Tananger (NO); Geir Gjelstad, Stavanger (NO); Ramya Priyadarsini Selvamurugan, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/601,728

(22) Filed: Mar. 11, 2024

(65) Prior Publication Data

US 2024/0376795 A1 Nov. 14, 2024

Related U.S. Application Data

(60) Provisional application No. 63/501,589, filed on May 11, 2023.

(51) Int. Cl.
*E21B 33/12* (2006.01)
*E21B 23/06* (2006.01)

(52) U.S. Cl.
CPC ..... *E21B 33/1208* (2013.01); *E21B 23/06* (2013.01)

(58) Field of Classification Search
CPC ..... E21B 33/1208; E21B 23/06
See application file for complete search history.

(56) References Cited

U.S. PATENT DOCUMENTS

| | | | | |
|---|---|---|---|---|
| 1,147,339 | A | 7/1915 | Penhallegon | |
| 7,143,832 | B2 | 12/2006 | Freyer | |
| 9,243,473 | B2 | 1/2016 | Yang et al. | |
| 9,617,821 | B2 * | 4/2017 | Solhaug | E21B 33/127 |
| 11,047,203 | B2 | 6/2021 | Fripp et al. | |
| 11,136,850 | B2 | 10/2021 | Wellhoefer et al. | |
| 11,174,700 | B2 | 11/2021 | Fripp et al. | |
| 11,473,391 | B2 * | 10/2022 | Jakkula | E21B 33/1208 |

(Continued)

OTHER PUBLICATIONS

International Search Report and Written Opinion for International Patent Application No. PCT/US2024/020972 dated Jul. 10, 2024. PDF file. 8 pages.

(Continued)

*Primary Examiner* — Matthew R Buck
(74) *Attorney, Agent, or Firm* — Scott Richardson; C. Tumey Law Group PLLC

(57) ABSTRACT

Disclosed herein are wellbore packer assemblies and methods of use of these wellbore packer assemblies. The wellbore packer assemblies may include a protective material, a swellable material, and a tubular. The swellable material is disposed on the tubular, wherein the protective material is disposed on the swellable material and at least partially covering a portion of the swellable material. Methods of use of the wellbore packer assembly may include inserting into a wellbore the packer assembly, contacting the swellable material with a swelling fluid, swelling the swellable material to expand the protective material against a wellbore wall, and forming a seal between the protective material and the wellbore wall.

20 Claims, 7 Drawing Sheets

(56) References Cited

U.S. PATENT DOCUMENTS

| | | | | |
|---|---|---|---|---|
| 11,634,962 | B1 * | 4/2023 | Glaesman | E21B 21/003 166/387 |
| 2005/0199401 | A1 | 9/2005 | Patel et al. | |
| 2007/0151724 | A1 | 7/2007 | Ohmer et al. | |
| 2009/0242189 | A1 | 10/2009 | Vaidya et al. | |
| 2010/0139929 | A1 | 6/2010 | Rytlewski et al. | |
| 2011/0259578 | A1 * | 10/2011 | Kutac | E21B 33/1216 166/118 |
| 2013/0001881 | A1 * | 1/2013 | McRobb | E21B 33/1208 277/336 |
| 2013/0056227 | A1 | 3/2013 | Sponchia | |
| 2014/0361497 | A1 * | 12/2014 | Porta | E21B 33/1208 277/619 |
| 2015/0308214 | A1 * | 10/2015 | Bilansky | E21B 33/1208 166/387 |

OTHER PUBLICATIONS

Netherlands Search Report and Written Opinion for NL Patent Application No. 2037428 dated Aug. 21, 2024. English Machine Translation, PDF file. 7 pages.

Merriam-Webster Dictionary, "abut," Merriam-Webster.com Dictionary, Merriam-Webster, https://www.merriam-webster.com/dictionary/abut (last accessed May 5, 2025).

* cited by examiner

PROTECTIVE LAYER OVER SWELLABLE COMPOUND

CROSS-REFERENCE TO RELATED APPLICATION

The present application claims priority to U.S. Provisional Application No. 63/501,589, filed May 11, 2023, the entire disclosure of which is incorporated herein by reference.

BACKGROUND

Wellbores are commonly drilled to enable the production of subterranean fluids such as hydrocarbons (e.g., oil and gas). A wellbore is formed using a drill bit at the lower end of a drill string. The drill bit is rotated while force is applied through the drill string and against the rock face of the formation being drilled. After drilling to a predetermined depth, the drill string and bit are removed, and the wellbore is lined with a string of casing. The casing string may provide a conduit for conveying produced subterranean fluids from one or more subterranean formations (e.g., reservoirs) to a surface location. Wellbore equipment, which may be placed in or connected to the wellbore may include one or more devices which either promote or impede the production of subterranean fluids from a subterranean formation to a surface location. For example, pumps may be utilized to convey subterranean fluids to a surface location, while production isolation devices may prevent the production of subterranean fluids. An annular area is thus formed between the string of casing and the formation penetrated by the wellbore.

A cementing operation is typically conducted to displace drilling fluid and fill part or all of the hollow-cylindrical annular area between the casing and the borehole wall with cement. The combination of cement and casing strengthens the wellbore and facilitates the zonal fluid isolation of certain sections of a hydrocarbon-producing formation (or "pay zones") behind the casing. The first string of casing is placed from the surface and down to a first drilled depth. This casing is known as a surface casing. In the case of offshore operations, this casing may be referred to as a conductor pipe. Typically, one of the main functions of the initial string(s) of casing is to isolate and protect the shallower, usable water bearing aquifers from contamination by any other wellbore fluids. Accordingly, these casing strings are almost always cemented entirely back to surface. One or more intermediate strings of casing are also run into the wellbore. These casing strings will have progressively smaller outer diameters into the wellbore. In most current wellbore completion jobs, especially those involving so called unconventional formations where high-pressure hydraulic operations are conducted downhole, these casing strings may be entirely cemented. In some instances, an intermediate casing string may be a liner which is a string of casing that is not tied back to the surface.

The process of drilling and then cementing progressively smaller strings of casing is repeated several times until the well has reached total depth. In some instances, the final string of casing is also a liner. The final string of casing, referred to as a production casing, is also typically cemented into place. Additional tubular bodies may be included in a well completion. These include one or more strings of production tubing placed within the production casing or liner. Each tubing string extends from the surface to a designated depth proximate a production interval, or "pay zone." Each tubing string may be attached to a packer. The packer serves to seal off the annular space between the production tubing string(s) and the surrounding casing.

Swellable packers are used in open hole and cased hole applications to support production equipment, set liners, set plugs, and in various other wellbore construction operations. Swellable packers typically include a swellable material disposed on a tubular where the swellable material swells on contact with a fluid, expanding to form an annular seal. The swellable material used to construct the packer may be sensitive to fluids present in the wellbore. For example, in wellbores where corrosive fluids are present such as acids, amines, hydrogen sulfide, and carbon dioxide, there may be additional considerations for the long-term integrity of the in-well equipment such as swellable packers. For instance, a swellable packer sheath which is exposed to a corrosive fluid may begin to uptake the corrosive fluid into the matrix of the swellable packer which may cause chemical and physical changes within the swellable packer. Swellable packers exposed to corrosive fluids may behave like a composite material with spatially varying mechanical properties. Fluids and gases in the reservoir may change the volume of the swellable packer, which may compromise the ability of the swellable packer to provide zonal isolation.

BRIEF DESCRIPTION OF THE DRAWINGS

These drawings illustrate certain aspects of some of the embodiments of the present disclosure and should not be used to limit or define the method.

DETAILED DESCRIPTION

The present disclosure may generally relate to swellable packers and methods of deploying swellable packers in wellbore. More particularly, the present disclosure relates to swellable packers comprising a protective material covering at least partially a swellable material with enhanced protection against chemical and physical changes once the swellable packer is deployed in a wellbore. The swellable material is disposed on the tubular of the wellbore packer assembly and may swell upon contact with a swelling fluid or a material changing fluid such as a downhole fluid (i.e., oil, gas, brine, carbon dioxide, and any combination thereof). The swelling of the swellable material expands the protective material against the wellbore wall forming a seal.

Figure 1:
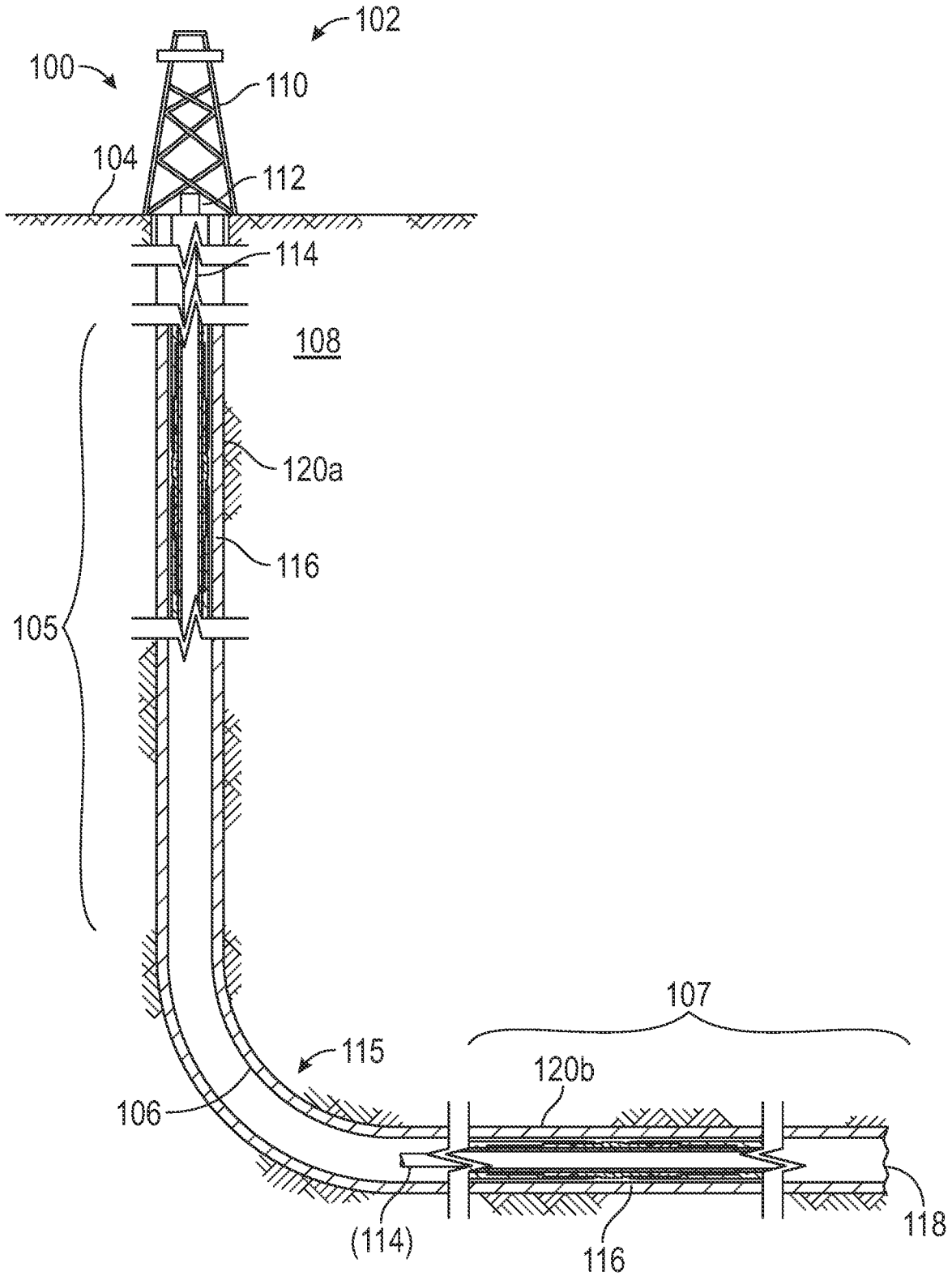
FIG. 1 is a schematic view of a well system with one or more scaling tools (e.g. a packer) according to some embodiments of the present disclosure.

FIG. 1 is a schematic view of a well system 100 as an example environment in which one or more sealing tools e.g., packers 120 *a*, 120 *b*, may be deployed to seal along a wellbore 106. Wellbore 106 traverses a subterranean earth formation 108 which includes hydrocarbons such as oil and gas. Well system 100 may include an oil and gas rig 102 arranged at the earth's surface 104 above the wellbore 106. Rig 102 may include a large support structure such as a derrick 110, erected over the wellbore 106 on a support foundation or platform, such as a rig floor 112. Even though certain drawing features of FIG. 1 depict a land-based oil and gas rig 102, it will be appreciated that the embodiments of the present disclosure are useful with other types of rigs, such as offshore platforms or floating rigs used for subsea wells, and in any other geographical location. For example, in a subsea context, the earth's surface 104 may be the floor of a seabed, and the rig floor 112 may be on the offshore platform or floating rig over the water above the seabed. A subsea wellhead may be installed on the seabed and accessed via a riser from the platform or vessel.

Wellbore 106 may extend through the various earth strata including subterranean earth formation 108. Wellbore 106 may be drilled according to a wellbore plan to reach one or more target formations, to avoid non-desirable formation features, to minimize footprint of the well at the surface, and to achieve any other objectives for the well. Wellbore 106 may follow a chosen path (i.e., the wellbore path) from where the wellbore 106 initiated at the earth's surface 104 (i.e., the "heel") to the end of the well 118 (i.e., the "toe"). The initial portion of wellbore 106 is typically vertically downward as the drill string would generally be suspended vertically from rig 102. Thereafter, wellbore 106 may deviate in any direction as measured by azimuth or inclination, which may result in sections that are vertical, horizontal, angled up or down, and/or curved. The term uphole generally refers to a direction along the wellbore path toward the earth's surface 104 and the term downhole generally refers to a direction toward the toe at the end of the well 118, without regard to whether a feature is vertically upward or vertically downward with respect to a reference point. The wellbore path in FIG. 1 is simplified for case of illustration and is not up to scale. In this example, the wellbore path includes an initial, vertical section 105, followed by at least one deviated section 115 downhole of the vertical section 105, which transitions from the vertical section 105 to a horizontal or lateral section 107 downhole of the deviated section 115. Thus, the vertical section 105 is uphole of the deviated section 115 and lateral section 107.

Wellbore 106 may be at least partially cased with a casing string 116 at selected locations within the wellbore 106, while other portions of wellbore 106 may remain uncased. The casing string 116 may be secured within wellbore 106 using cement. In other embodiments, the casing string 116 may be only partially cemented within wellbore 106 or, alternatively, the casing string 116 may be entirely uncemented. Casing string 116 may be made from any material such as metals, plastics, composites, or the like, may be expanded or unexpanded as part of an installation procedure. Production tubing may be any suitable tubing string utilized in the production of hydrocarbons. In examples, production tubing may be permanently disposed within casing string 116. The packers 120 *a*, 120 *b*, may be disposed on or near production tubing.

Rig 102 may include a hoisting apparatus for raising and lowering equipment from derrick 110 on conveyance 114. Conveyance 114 may serve various functions, such as to lower and retrieve tools, to convey fluids, and to support electrical communication, power, and fluid transmission during wellbore operations. Conveyance 114 may include any suitable equipment for mechanically conveying tools such as the packers 120 *a*, 120 *b*, and any suitable packer setting assembly for setting the packers 120 *a*, 120 *b*. Such conveyance may include, for example, a tubular string made up of interconnected tubing segments, or wireline, slickline, coiled tubing, or any combination of any of the foregoing. In some examples, conveyance 114 may provide mechanical suspension, as well as electrical and fluidic connectivity, for downhole tools like the packers 120 *a*, 120 *b*. Conveyance 114 may be used to lower one or more tools into wellbore 106, i.e. run/tripped into the hole. When a wellbore operation is complete, or when it becomes necessary to exchange or replace tools or components of conveyance 114, conveyance 114 may be raised or fully removed from wellbore 106, i.e., tripped out of the hole. The packers 120 *a*, 120 *b* are examples of downhole tools that may be deployed on conveyance 114. The packers 120 *a*, 120 *b* may be actuated at selected locations to seal off a portion of wellbore 106.

One or more packers or other sealing tools according to this disclosure may be set for any of a variety of sealing purposes. As depicted in FIG. 1, the two packers 120 *a*, 120 *b*, may represent the same packer being tripped down wellbore 106 at two different checkpoints. For example, the location at packer 120 *a* may represent the packer as it is being deployed in a run-in condition through the vertical section 105, and the location at packer 120 *b* may represent the same packer after it has been deployed further down into the deviated section 115 and set. Alternatively, the packers 120 *a*, 120 *b* may represent two different packers to be deployed to different locations in wellbore 106. For example, the second packer 120 *b* may be a packer that has already been deployed and set in the lateral section 107 of wellbore 106, and the first packer 120 *a* may be another packer deployed to the vertical section 105 but has not yet been set.

A variety of packer types may be utilized according to this disclosure, including but not limited to production packers and service packers. Suitable types of packers may include whether they are permanently set or retrievable, mechanically set, hydraulically set, and/or any combinations thereof. As just one example, the packers 120 *a* and/or 120 *b* may be production packers that will remain in the well during well production. Alternatively, the packers 120 *a* and/or 120 *b* may be service packers used temporarily during well servicing, such as cementing, acidizing, or fracturing. When set, packer 120 may isolate zones of the annulus between wellbore 106 and a tubing string by providing a seal between production tubing and casing string 116. In examples, a packer may be disposed on production tubing. Downhole setting tools may also be disposed on conveyance 114 and run into wellbore 106 for actuating the packers 120 *a*, 120 *b*.

Figure 2:
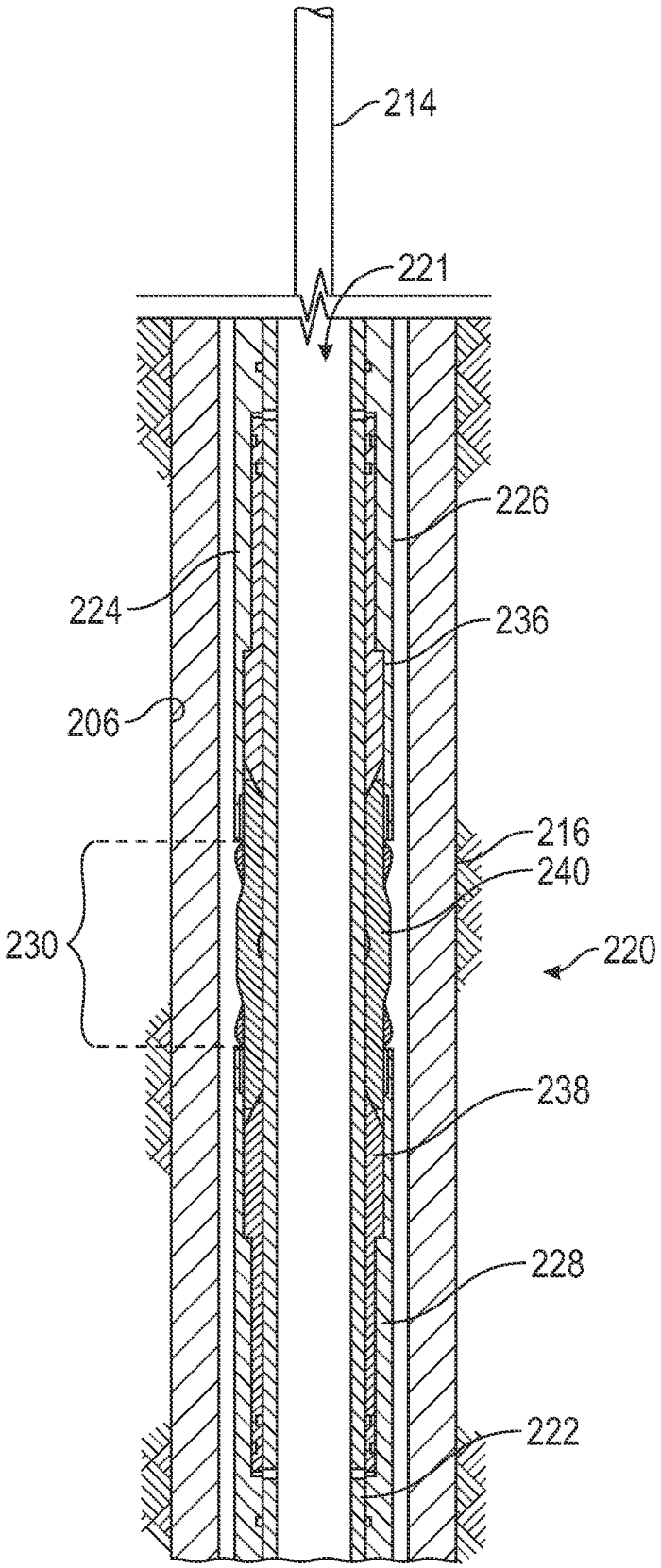
FIG. 2 is a schematic of an enlarged view of a packer according to some embodiments of the present disclosure.

FIG. 2 is an enlarged view of one of the packers 120 of FIG. 1 being deployed into wellbore 106 in a run-in condition, wherein the sealing element 240 is unexpanded while it is tripped downhole prior to set. Casing 216 is tubular in shape to conform to the generally circular profile of wellbore 206 having been drilled with a rotary drill bit. Likewise, the packer 220 has a generally circular outer profile, to fit within the generally tubular profile of wellbore 206 as it is tripped downhole, and to conform with the casing 216 when set. The packer 220 includes a mandrel 222 coupled to a conveyance 214 for lowering the packer 220 into the well. The mandrel 222 has an internal fluid passage ("bore") 221 for internally conveying fluids. Mandrel 222 also supports one or more other packer components including the sealing element 240. Mandrel 222 has a generally circular cross-sectional profile. The various other packer components mounted radially external to mandrel 222 may also have circular cross-sections that may vary along the axial direction of mandrel 222. The other packer components include, for example, a shroud 224. Shroud 224 includes upper shroud portion 226 and lower shroud portion 228 axially spaced along mandrel 222. A gland opening 230 is defined between the upper and lower shroud portions 226, 228 through which the scaling element 240 may be expanded. The sealing element 240 is captured at opposing ends between mandrel 222 and the respective shroud portions 226, 228, with the scaling element 240 spanning the gland opening 230.

To achieve high element expansion and a high-pressure sealing system with minimal hydraulic setting force, the sealing element may be deployed outwardly by expanding it over a dual prop and piston arrangement. A pair of opposing props 236, 238 are radially disposed between an outside diameter (OD) of mandrel 222 and the shroud 224. The props 236, 238 are axially moveable toward one another to selectively engage the sealing element 240 in order to urge the scaling element 240 outwardly through the gland opening 230 into scaling engagement with an inner diameter (ID) of the casing 216.

Over the life of an oil and gas well, production of reservoir fluids depletes the reservoir leaving behind a volume which may be used to store carbon dioxide, i.e. a carbon dioxide injection zone. The carbon dioxide injection zone can include subterranean formations where hydrocarbons were produced and depleted from. These depleted wells can be utilized to store carbon dioxide ($CO_2$) by injecting carbon dioxide into the carbon dioxide injection zone to transform the depleted well to a carbon capture underground storage (CCUS) well. As discussed above, swellable packers are utilized in construction of the wellbore and therefore when a depleted well is converted to a CCUS well, the swellable packers may be exposed to carbon dioxide. In some embodiments, differential pressure across the swellable packer is reduced by placing a fluid above the packer. For example, the swellable packers of the present disclosure can be exposed to carbon dioxide and water or a benign fluid as the benign fluid is injected into the upper stratum above the carbon dioxide injection layer and its cap-rock to reduce the upward leakage rates of carbon dioxide during and after its injection.

Figure 3:
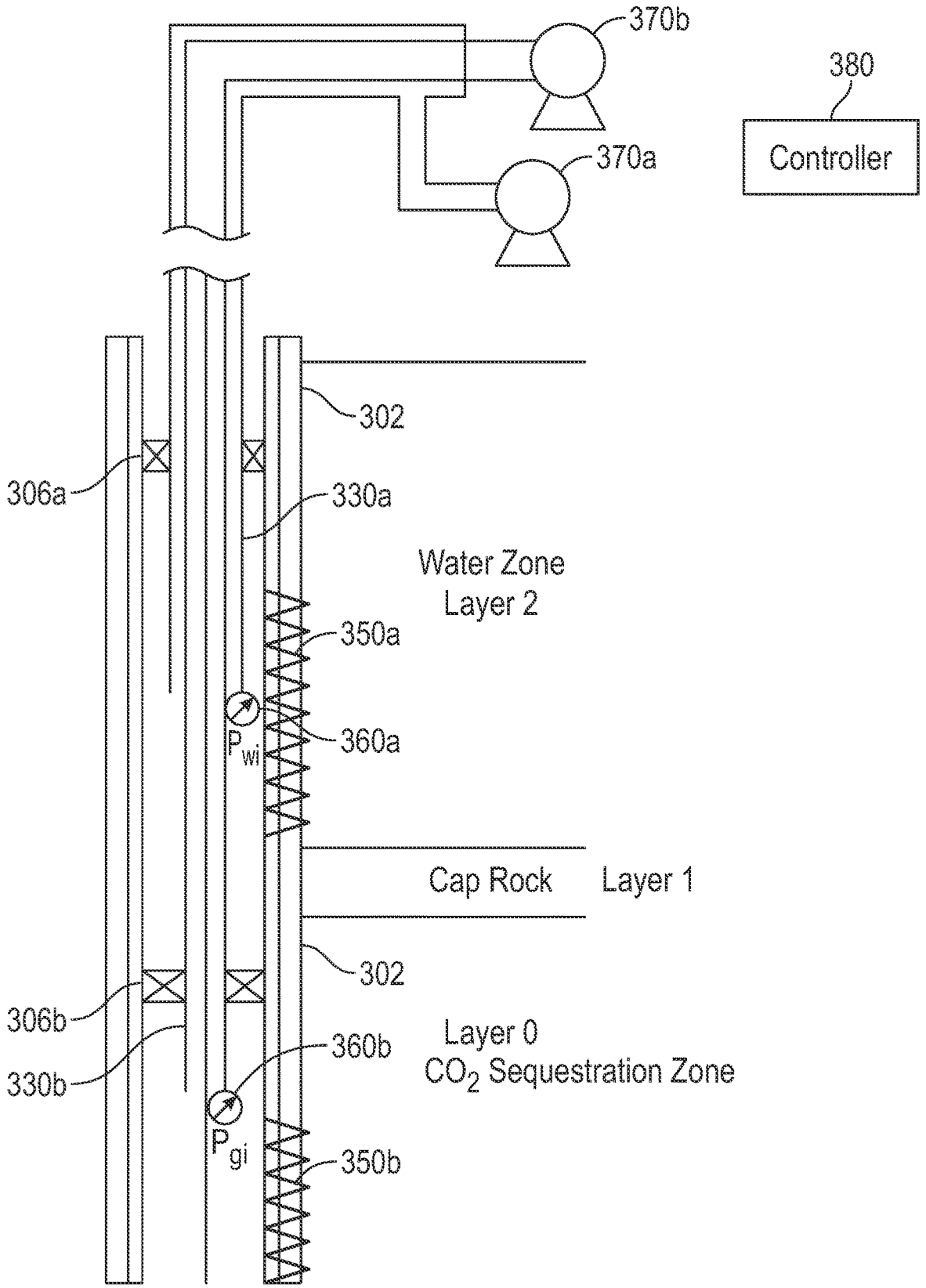
FIG. 3 is a schematic showing a dual completion well with packers according to some embodiments of the present disclosure.

Turning now to FIG. 3 which illustrates a cased wellbore 302 penetrating a subterranean formation. The formation includes many layers or zones although only three layers are shown in FIG. 3. Layer 0 is capped by nearly impermeable layer 1. Above layer 1 is a permeable stratum, layer 2. Layer 2 in turn is overlain by another nearly impermeable layer of shale or shaly sand, for example. As shown in FIG. 3, wellbore 302 includes a dual completion installed. Coaxial tubes 330*a*, 330*b* are provided with respective packers 306*a*, 306*b* such that tube 330*a* is in fluid communication with layer 2 of the formation via casing perforations 350*a*, and tube 330*b* is in communication with layer 0 of the formation via casing perforations 350*b*. Pressure sensors 360*a*, 360*b* are provided in conjunction with tubes 330*a* and 330*b*. Supercritical carbon dioxide is injected by suitable means, e.g., pressure controlled pump 370*b* into layer 0 via tube 330*b* (displacing brine in that layer). In embodiments a compatible fluid such as water (e.g., brine) is injected by suitable means, e.g., pressure-controlled pump 370*a* into layer 2 via tube 330*a* at a pressure at least equal to that of the pressure of layer 0 corrected for the gravitational head of the respective fluids. The pressure of pumps 370*a*, 370*b* is preferably controlled by a controller 380 which receives information from pressure sensors 360*a*, 360*b* and which causes the pumps 370*a*, 370*b* to pump the supercritical carbon dioxide and brine into layers 0 and 2 of the formation as described more completely hereinafter in order to properly sequester the carbon dioxide in layer 0. Therefore, swellable packers 306*b* of the present disclosure are exposed to supercritical carbon dioxide and brine at the same time.

However, carbon dioxide is a corrosive fluid which can change the properties of a swellable packer. Furthermore, the operational conditions in which the carbon dioxide ($CO_2$) is introduced into the wellbore such as temperature, pressure, and state of the $CO_2$ such as gaseous $CO_2$, liquid (supercritical) $CO_2$, or $CO_2$ dissolved in water (carbonic), each can affect the extent of carbonation of the swellable packer. The swellable packer of the present disclosure including the protective material covering at least partially the swellable material may be utilized in any wellbore type, including wellbore environments which contain carbon dioxide, where the swellable packer of the present disclosure may have extended life as compared to conventional swellable packers. The swellable packer of the present disclosure may be utilized in wellbores where corrosive fluids are present, including, but not limited to, acids, amines, and hydrogen sulfide where the swellable packer including the protective material covering at least partially the swellable material may have extended life as compared to conventional swellable packers. Therefore, the swellable packer of the present disclosure may be used for $CO_2$ injection well, secondary oil recovery, enhanced oil recovery, or any wellbore treatment, for example.

The swellable packers of the present disclosure include a protective material covering at least partially a swellable material with enhanced protection against chemical and physical changes once the swellable packer is deployed in a wellbore. The protective material may be any material that can protect the swellable material including metals, polymers, ceramics, composites, and any combination thereof. The protective metal may be any pure metal or any alloy capable of enhanced protection against the downhole environment including any ferrous alloys, for example. The protective metal may be in the form of a metallic flap that is displaced upon expansion of the swellable material, for example. The protective polymer may be any polymeric material capable of enhanced protection against the downhole environment including any elastomer, thermoset, and thermoplastic such as styrene butadiene, natural rubber, ethylene propylene monomer rubber, ethylene propylene diene monomer rubber, ethylene vinyl acetate rubber, hydrogenated acrylonitrile-butadiene rubber, acrylonitrile butadiene rubber, isoprene rubber, chloroprene rubber, polynorbornene, EPDM, nitrile rubber, HMBR, acrylonitrile, hydrogenated nitrile, chloroprene, ethylene vinylacetate rubber, silicone, ethylene propylene diene monomer, butyl, chlorosulphonated polyethylene, polyurethane, ACM, BIMS, and any combinations thereof. The protective ceramic may be any ceramic material capable of enhanced protection against the downhole environment including any traditional ceramic or any engineered ceramic. The protective composite may be any composite material capable of enhanced protection against the downhole environment including metal matrix composite, polymer matrix composite, or ceramic matrix composite.

The protective material may be swellable or non-swellable in presence of material changing fluid such as oil, gas, brine, carbon dioxide, acid, cement, and any combination thereof. Non-swellable protective materials include metals and polymers such as Teflon and hydrogenated nitrile butadiene rubber (HNBR), for example. Swellable protective materials include polymers such as ethylene propylene diene monomer rubber (EPDM), for example.

The protective material may be bonded with the swellable material to form a single structure. In embodiments, the bond is formed by a suitable method including but not limited to a mechanical method such as clamping the protective material and the swellable material together, pressing fitting the protective material against the swellable material, thermally bonding the protective material and the swellable material such as by contacting and heating the protective material and swellable material together, and/or a chemical method including utilizing a polymerization additive to form a polymer bond (e.g. vulcanization) or using a glue.

Figure 4:
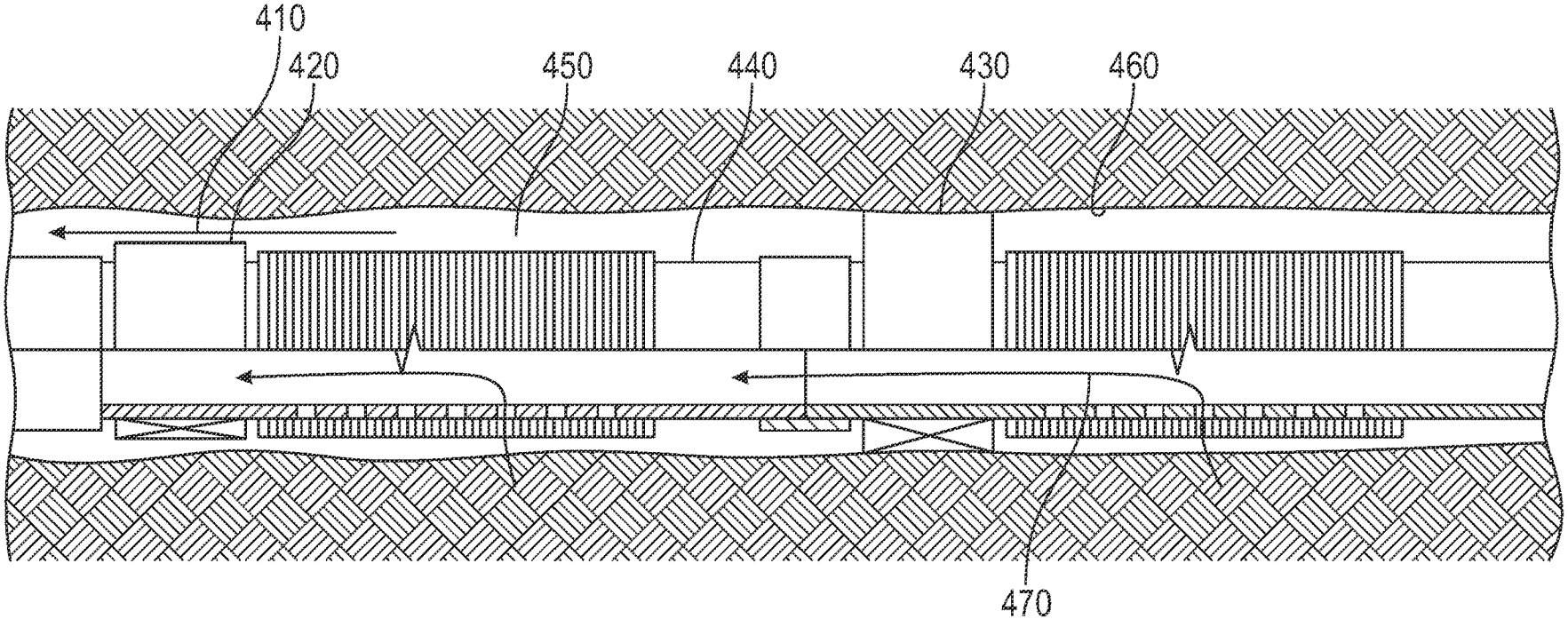
FIG. 4 is a longitudinal section through an area of a $CO_2$ injection well in accordance with some embodiments of the present disclosure.

Reference is made to FIG. 4 which illustrates a longitudinal section through an area of a wellbore. As shown in FIG. 4, annular packer 420 is disposed on the outside of a pipe 440, said packer expands swelling upon exposure for and absorption of a fluid. The annular packer 420 swells by contact with a swelling fluid 410. Swelling fluid 410 may be introduced into the wellbore after the annular packer is introduced to the swelling fluid may be present in the wellbore when the annular packer 420 is introduced. The annular packer can be made of materials which swell in different types of swelling fluids such as an oil-based fluid, an aqueous based fluid, or may be hybrid swelling to swell in both oil and water-based fluid. The annular packer 420 therefore seals the annular space 450 towards the wellbore wall 460. The wellbore may be an open-hole well or a well with a casing, where the production tubing 440 is drawn in an open hole or that the production tubing 440 is drawn in a casing, respectively. Thus, annular space 450 consists of the external surface of the production tubing 440 and the wellbore wall 460, or the external surface of the production tubing 440 and the internal surface in the casing, respectively. As shown in FIG. 4, swelling fluid 410 flows past annular packer 420 before the annular packer 420 is expanded and scaled towards wellbore wall 460. An annular packer 430 is shown as expanded and scaling towards the wellbore wall 460 so that a well fluid 470 cannot bypass the packer element in the annular space 450.

Figure 5A:
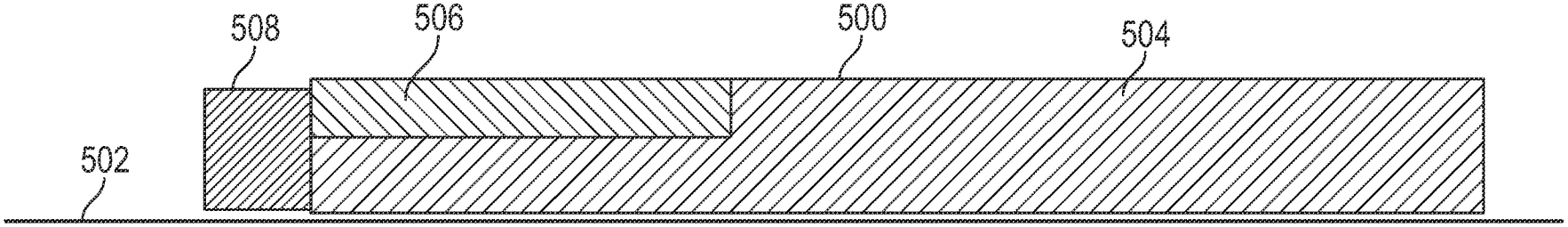
FIG. 5A is a longitudinal section of a tubing with an annular packer in accordance with some embodiments of the present disclosure.

FIG. 5A is a longitudinal section of a tubing with an annular packer. As shown in FIG. 5A, packer assembly 500 is disposed on outside of tube 502. Packer assembly 500 comprises a packer element 504, a protective element 506, and end ring 508. Packer element 504 may be constructed from a material which will swell when contacted with a swelling fluid. For example, packer element 504 may comprise an oil or water swellable material. In some embodiments the packer element may include materials such as styrene butadiene, natural rubber, ethylene propylene monomer rubber, ethylene propylene diene monomer (EPDM) rubber, ethylene vinyl acetate rubber, hydrogenized acrylonitrile-butadiene rubber, acrylonitrile butadiene rubber, isoprene rubber, chloroprene rubber, polynorbornene, and combinations thereof. Protective element 506, may be constructed from a material which does not swell in a swelling fluid. Alternatively, protective element 506 may have relatively less swelling when contacted with a swelling fluid than the material in packer element 504. For example, protective element 506 may include a polymeric material such as EPDM rubber, nitrile rubber, and combinations thereof. Protective element 506 may also include, without limitation, acrylonitrile, hydrogenated nitrile, chloroprene, ethylene vinylacetate rubber, silicone, ethylene propylene diene monomer, butyl, chlorosulphonated polyethylene, polyurethane, ACM, BIMS, and combinations thereof. The protective element 506 may have less propensity to swell in the swelling fluid than the packer element 504. For example, the protective element 506 may be less diffusive to swelling in fluids such as hydrocarbons, and have a lower expansion when exposed to swelling fluids than the packer element 504. The term "swellable" is used herein to indicate an increase in volume of a material. Typically, this increase in volume is due to incorporation of molecular components of a fluid into the swellable material itself, but other swelling mechanisms or techniques may be used, if desired. The swellable material may swell when contacted by an activating agent, such as an inorganic or organic fluid. In one embodiment, a swellable material may be a material that swells upon contact with and/or absorption of a hydrocarbon, such as oil. In another embodiment, a swellable material may be a material that swells upon contact with and/or absorption of an aqueous fluid.

Figure 5B:
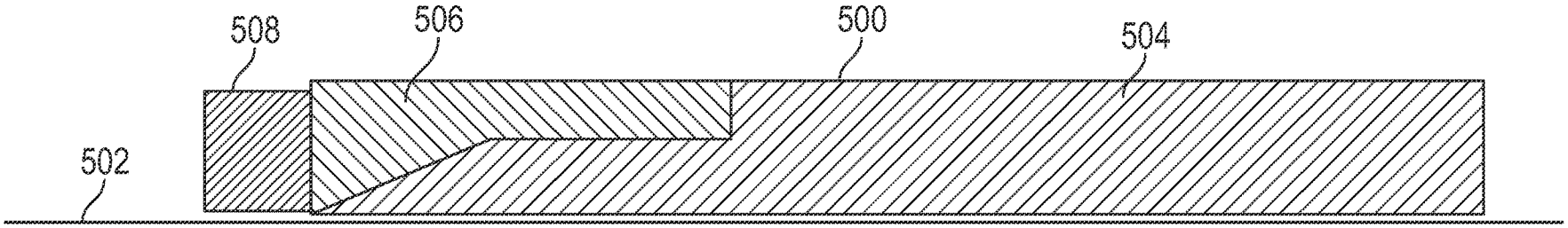
FIG. 5B is a longitudinal section of a tubing with an annular packer in accordance with some embodiments of the present disclosure.

In FIG. 5A, protective element 506 is shown as wrapping around tube 502 and abutting end ring 508 where both the packer element 504 and protective element 506 contact end ring 508. FIG. 5B shows an alternative configuration of the protective element 506 whereby only the protective element 506 abuts and contacts end ring 508. End ring 508 may be attached to tube 502 to provide a base for the abutting packer element 504 and/or protective element 506 to expand against.

Protective element 506 and packer element 504 may be any elastomeric sleeve, ring, or band suitable for creating a fluid tight seal with tube 502 and an outer tubing, casing, or wellbore in which tube 502 is disposed. The packer assembly 500 may be any material and have any shape and size. In certain embodiments, the packer assembly 500 may be designed for the conditions anticipated at each selected interval in which the isolation packer assembly 500 is being used, taking into account the expected temperatures and pressures, for example. In certain embodiments, only a portion of the packer assembly 500 such as packer element 504 may comprise a swellable material.

The packer element 504 has several advantages. For example, by layering a relatively less swelling material or a non-swelling material on top of a relatively more swelling material, the differential swelling of the packer element 504 causes the protective element 506 to be pushed against the borehole wall, either casing or open hole inner diameter, which creates a seal between the less swelling material and the borehole wall. The seal then further protects the packer element 504 from subsequent fluid exposures. In the example of the $CO_2$ storage wells of FIG. 3, a packer assembly 500 can be disposed in a wellbore and a swelling fluid is thereafter contacted with the packer element 504 causing the protective element 506 to seal against the borehole wall. The packer element 504 containing the more swelling material will be protected from subsequent injection of $CO_2$ by the sealing provided by the protective element 506 containing the less swelling material.

Figure 6A:
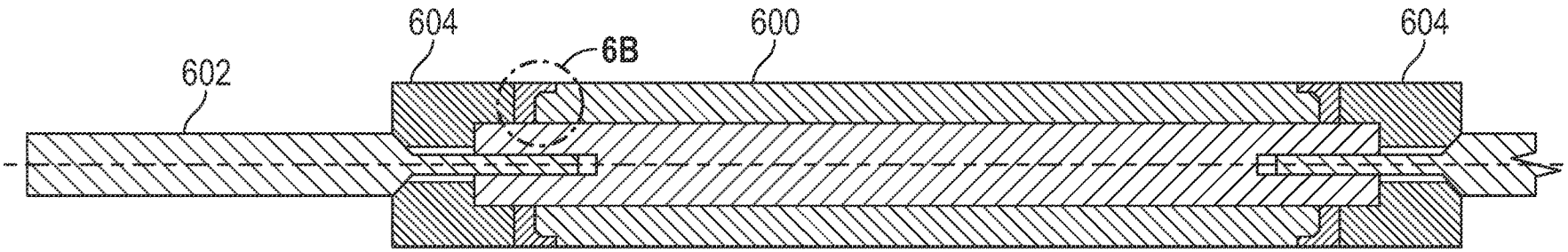
FIG. 6A is a longitudinal section of a tubing with an annular packer in accordance with some embodiments of the present disclosure.
Figure 6B:
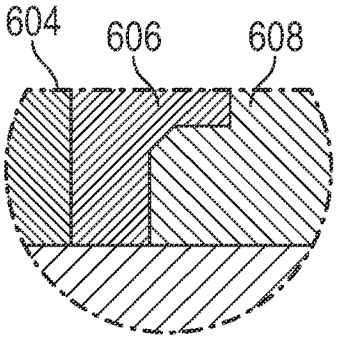
FIG. 6B is a longitudinal section of a tubing with an annular packer in accordance with some embodiments of the present disclosure.

FIG. 6A is a is a longitudinal section of a tubing 602 with an annular packer 600. As shown in FIG. 6A, annular packer 600 is disposed on tube 602 between end rings 604. FIG. 6B is a detailed view of FIG. 6A showing protective element 606 disposed between end ring 604 and packer element 608. When annular packer 600 and packer element 608 expand, protective element 606 is pushed against the borehole (not shown) and provides a seal against borehole. Protective element 606 will be exposed to the fluid downhole such as oil, gas, brine, carbon dioxide, any wellbore fluid treatment, or any combination thereof. Exposed protective element 606 will shield packer element 608 and annular packer 600 in general from these wellbore fluids.

Figure 7A:
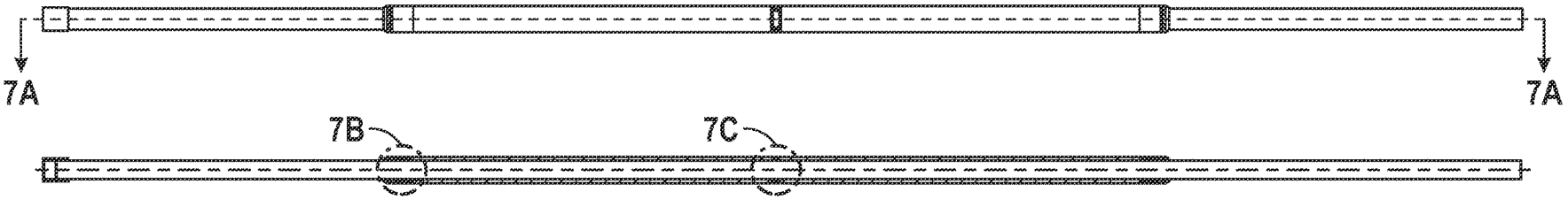
FIG. 7A is a representation of a full-scale annular packer in accordance with some embodiments of the present disclosure.
Figure 7B:
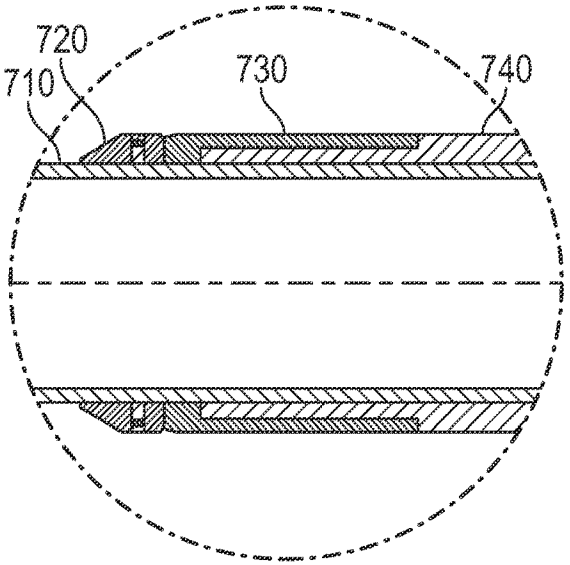
FIG. 7B is an enlargement of zone B of the representation of a full-scale annular packer in accordance with some embodiments of the present disclosure.
Figure 7C:
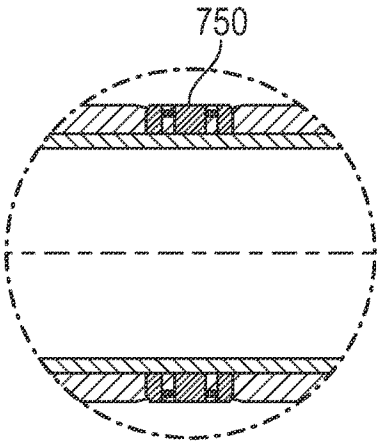
FIG. 7C is an enlargement of zone C of the representation of a full-scale annular packer in accordance with some embodiments of the present disclosure.

FIG. 7A is a representation of a full-scale annular packer in accordance with some embodiments of the present disclosure. Zone B represents a zone of contact between packer element 504 (referring to FIG. 5), protective element 506, end ring 508, and tube assembly 502. Zone C represents a zone of contact between packer element 504 (referring to FIG. 5) and protective element 506 in between two packer assemblies 500. FIG. 7B is an enlargement of zone B of the representation of a full-scale annular packer in accordance with some embodiments of the present disclosure. In FIG. 7B, Protective element 730 overlap packer element 740 and tube assembly 710 while being in adjacent contact with endcap 720. As shown in FIG. 7B, a step in packer element 740 will increase the contact surface area between packer element 740 and protective element 730. The increase in contact surface area optimizes the sealing capability with protective element 730, improves its swelling capability, and optimizes the scaling capability of protective element 730 with borehole wall (not shown) as the swelling of packer element 740 pushes protective element against borehole and thus the step in packer element 740 increases the contact surface area between protective element 730 and borehole wall. The improved scaling between protective element 730 and borehole wall will further prevent exposure of packer element 740 to downhole fluids. FIG. 7C is an enlargement of zone C of the representation of a full-scale annular packer in accordance with some embodiments of the present disclosure. As shown in FIG. 7C, packer element 750 is in contact with tube assembly 710.

Accordingly, the present disclosure may provide wellbore packer assemblies and methods of use of these wellbore packer assemblies which include a protective material, a swellable material, and a tubular. The methods and systems may include any of the various features disclosed herein, including one or more of the following statements.

Statement 1. A method comprising: inserting into a wellbore a packer assembly comprising; a protective material; a swellable material; and a tubular; wherein the swellable material is disposed on the tubular, wherein the protective material is disposed on the swellable material and at least partially covering a portion of the swellable material; contacting the swellable material with a swelling fluid; swelling the swellable material to expand the protective material against a wellbore wall; and forming a seal between the protective material and the wellbore wall.

Statement 2. The method of Statement 1, the wellbore penetrates a subterranean formation comprising a carbon dioxide injection zone and wherein the seal isolates the carbon dioxide injection zone.

Statement 3. The method of Statement 1 or Statement 2, wherein the protective material is disposed between an endcap and the swellable material and the endcap extends over the protective material.

Statement 4. The method of any previous Statements 1-3, further comprising protecting the swellable material from a material changing fluid by preventing the material changing fluid from flowing across the seal.

Statement 5. The method of any previous Statements 1-4, wherein the swellable material is protected from a material change selected from the group consisting of hardening, softening, embrittlement, volume change, and combinations thereof.

Statement 6. The method of any previous Statements 1-5, wherein the protective material and the swellable material are clamped together.

Statement 7. The method of any previous Statements 1-6, wherein the protective material is bonded to the swellable material by vulcanization.

Statement 8. The method of any previous Statements 1-7, wherein the protective material is bonded to the swellable material by at least one chemical selected from a polymerization additive, a glue, and combinations thereof.

Statement 9. The method of any previous Statements 1-8, wherein the protective material comprises hydrogenated nitrile butadiene rubber.

Statement 10. The method of any previous Statements 1-9, wherein the swellable material comprises ethylene propylene diene monomer.

Statement 11. The method of any previous Statements 1-10, wherein the protective material is a swellable material.

Statement 12. A wellbore packer assembly comprising, a protective material; a swellable material; and a tubular; wherein the swellable material is disposed on the tubular, wherein the protective material is disposed on the swellable material, and wherein the protective material covers at least a portion of the swellable material.

Statement 13. The system of Statement 12, wherein the protective material is disposed between an endcap and the swellable material.

Statement 14. The system of Statement 12 or Statement 13, wherein the protective material is disposed between an endcap and the swellable material and the endcap extends over the protective material.

Statement 15. The system of any previous Statement 12-14, wherein the protective material and the swellable material are clamped together.

Statement 16. The system of any previous Statements 12-15, wherein the protective material is bonded to the swellable material by vulcanization.

Statement 17. The system of any previous Statements 12-16, wherein the protective material is bonded to the swellable material through a chemical additive.

Statement 18. The system of any previous Statements 12-17, wherein the protective material comprises hydrogenated nitrile butadiene rubber.

Statement 19. The system of any previous Statements 12-18, wherein the swellable material comprises ethylene propylene diene monomer rubber.

Statement 20. The system of any previous Statements 16-19, wherein the protective material is a swellable material.

It should be understood that the compositions and methods are described in terms of "comprising," "containing," or "including" various components or steps, the compositions and methods can also "consist essentially of" or "consist of"

the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular examples disclosed above are illustrative only, as the present disclosure may be modified and practiced in different but equivalent manners apparent to those skilled in the art having the benefit of the teachings herein. Although individual examples are discussed, the disclosure covers all combinations of all those examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A method comprising:

inserting into a wellbore a packer assembly comprising:

a protective material;

a swellable material;

a tubular; and an end ring;

wherein the swellable material is disposed on the tubular, wherein the protective material is disposed on the swellable material and at least partially covering a portion of the swellable material, and wherein the swellable material and the protective material abut the end ring;

contacting the swellable material with a swelling fluid;

swelling the swellable material to expand the protective material against a wellbore wall; and forming a seal between the protective material and the wellbore wall.

2. The method of claim 1, wherein the wellbore penetrates a subterranean formation comprising a carbon dioxide injection zone and wherein the seal isolates the carbon dioxide injection zone.

3. The method of claim 1, wherein the swellable material and the end ring extends over the protective material.

4. The method of claim 1, further comprising protecting the swellable material from a material changing fluid by preventing the material changing fluid from flowing across the seal.

5. The method of claim 4, wherein the swellable material is protected from a material change selected from the group consisting of hardening, softening, embrittlement, volume change, and combinations thereof.

6. The method of claim 1, wherein the protective material and the swellable material are clamped together.

7. The method of claim 1, wherein the protective material is bonded to the swellable material by vulcanization.

8. The method of claim 1, wherein the protective material is bonded to the swellable material by at least one chemical selected from a polymerization additive, a glue, and combinations thereof.

9. The method of claim 1, wherein the protective material comprises hydrogenated nitrile butadiene rubber.

10. The method of claim 1, wherein the swellable material comprises ethylene propylene diene monomer rubber.

11. The method of claim 1, wherein the protective material is a swellable material.

12. A wellbore packer assembly comprising:

a protective material;

a swellable material; and a tubular;

wherein the swellable material is disposed on the tubular, wherein the protective material is disposed on the swellable material, wherein the protective material covers at least a portion of the swellable material, and wherein the protective material and the swellable material are clamped together with a clamp, and wherein the swellable material is configured to expand the protective material against a wellbore wall to form a seal therewith.

13. The wellbore packer assembly of claim 12, wherein the protective material is disposed between an endcap and the swellable material.

14. The wellbore packer assembly of claim 12, wherein the protective material is disposed between an endcap and the swellable material and the endcap extends over the protective material.

15. The wellbore packer assembly of claim 12, wherein the protective material is bonded to the swellable material by vulcanization.

16. The wellbore packer assembly of claim 12, wherein the protective material is bonded to the swellable material through a chemical additive.

17. The wellbore packer assembly of claim 12, wherein the protective material comprises hydrogenated nitrile butadiene rubber.

18. The wellbore packer assembly of claim 12, wherein the swellable material comprises ethylene propylene diene monomer rubber.

19. The wellbore packer assembly of claim 12, wherein the protective material is a swellable material.

20. A method comprising:

inserting into a wellbore a packer assembly comprising:

a protective material;

a swellable material; and a tubular;

wherein the swellable material is disposed on the tubular, wherein the protective material is disposed on the swellable material and at least partially covering a portion of the swellable material, and wherein the protective material and the swellable material are clamped together, with a clamp;

contacting the swellable material with a swelling fluid;

swelling the swellable material to expand the protective material against a wellbore wall; and forming a seal between the protective material and the wellbore wall.

* * * * *